United States Patent [19]

Niino

[11] Patent Number: 4,885,560

[45] Date of Patent: Dec. 5, 1989

[54] THERMAL RELAY

[76] Inventor: Masahiko Niino, Yamada Electric Mfg. Co., Ltd., 55, Kami Iida Minami-machi 5 Chome, Kita-ku, Nagoya, Japan

[21] Appl. No.: 313,756

[22] Filed: Feb. 22, 1989

[30] Foreign Application Priority Data

Sep. 21, 1988 [JP] Japan ..... 63-123318

[51] Int. Cl.[4] ..... H01H 37/02; H01H 71/18

[52] U.S. Cl. ..... 337/3; 337/4; 337/140; 337/299

[58] Field of Search ..... 337/3, 4, 5, 299, 140, 337/365, 89, 53

[56] References Cited

U.S. PATENT DOCUMENTS

| | | | |
|---|---|---|---|
| 4,047,141 | 9/1977 | Holden | 337/89 |
| 4,295,114 | 10/1981 | Pohl | 337/3 |
| 4,675,642 | 6/1987 | Reiferscheid | 337/140 |

*Primary Examiner*—H. Broome

*Attorney, Agent, or Firm*—Steele, Gould & Fried

[57] ABSTRACT

A thermal relay includes a housing, two fixed contacts secured to respective terminals disposed in the housing, a disc-shaped bimetal disposed in the housing and having two movable contacts made into and out of engagement with the respective fixed contacts, an adjusting screw including a screw portion and a head portion which are coupled with each other by a meltable metal, and a coil spring biasing the disc-shaped bimetal to the head portion of the adjusting screw to thereby support it.

2 Claims, 2 Drawing Sheets

THERMAL RELAY

BACKGROUND OF THE INVENTION

1. Field of the Invention

The present invention relates to thermal relays providing thermal protection for electrical machines and apparatus such as electric motors against overcurrent.

2. Description of the Prior Art

In electrical machines and apparatus, for example, electric motors, overcurrent, when occurring owing to an overload or the like, must be immediately detected to interrupt the motor winding circuit so that the motor can be protected against the overcurrent. Thermal relays utilizing a bimetallic member have been conventionally employed for providing for such overcurrent protection.

FIG. 6 illustrates a conventional thermal play of the type described above. A disc-shaped bimetallic member 2 having two movable contacts 3 secured to the respective opposite ends thereof is provided in a housing 1 formed from an electrically insulating material. The disc-shaped bimetallic member 2 is biased against the head 8a of an adjusting screw 8 by a coil spring 7 and held in position. A terminal 5 provided with two fixed contacts 4 is secured to the housing 1. The movable contacts 3 are adapted to move into and out of engagement with the fixed contacts 4, respectively. A heater 6 is provided beneath the disc-shaped bimetallic member 2 in the housing 1.

An overcurrent, when induced in the motor winding circuit, is drawn into the heater 6 and causes the temperature of the heater 6 to increase. When the temperature of the heater 6 reaches a predetermined value, the disc-shaped bimetallic member 2 reverses its curvature with snap action so that the movable contacts 3 are made out of engagement with the respective fixed contacts 4, thereby interrupting the motor winding circuit. Thereafter, when the temperature of the heater 6 is decreased below the predetermined value, the disc-shaped bimetallic member 2 reverses its curvature again so that the movable contacts 3 are made into engagements with the respective fixed contacts 4.

According to the above-described conventional construction, however, unless the cause of the overcurrent occurrence in the motor winding circuit is eliminated, the disc-shaped bimetallic member 2 reiternatively reverses its curvature so that the movable contacts 3 are reiteratively made into and out of engagement with the respective fixed contacts 4. In such conditions, the movable contacts 3 are at last caused to be welded to the respective fixed contacts 4 and accordingly, the disc-shaped bimetallic member 2 is prevented from reversing its curvature, whereby the motor winding circuit cannot be interrupted even in the occurrence of an overcurrent. It will be considered that when the heater 6 is disconnected from the motor winding circuit owing to the overheating, the motor winding circuit may be interrupted. However, when such disconnection of the heater 6 is not expected, the overcurrent keeps flowing through the motor winding circuit, which results in a critical condition that the motor is burned out.

SUMMARY OF THE INVENTION

Therefore, a primary object of the present invention is to provide a thermal relay wherein the circuit of the electrical machine connected thereto can be broken even when the movable and fixed contacts are welded to each other, thereby preventing the electrical equipment from burning out.

A second object of the present invention is to provide a thermal relay wherein the circuit of the electrical machine connected thereto can be reliably interrupted even when the electrical machine is of the high power type and when the welding force of the movable and fixed contacts are large.

In order to achieve the primary object, the thermal relay in accordance with the invention comprises a housing, two fixed contacts provided in the housing, a disc-shaped bimetallic member having two movable contacts and provided in the housing, an adjusting screw provided in the housing and comprising a screw portion and a head portion which are coupled with each other by a meltable metal, and a spring member biasing the disc-shaped bimetallic member against the head portion of the adjusting screw. The disc-shaped bimetallic member is adapted to usually have a first curvature so that the movable contacts are made into engagement with the respective fixed contacts. When the disc-shaped bimetallic member is subjected to heat and the temperature thereof is increased to a predetermined value, the bimetallic member is adapted to reverse its curvature so as to have a second curvature, whereby the movable contacts are made out of engagement with the fixed contacts.

According to the above-described thermal relay, when the overcurrent flows through the circuit of the electrical machine, the disc-shaped bimetallic member reverses its curvature so as to have the second curvature so that the movable contacts are made out of engagement with the respective fixed contacts. When the movable and fixed contacts are welded to each other owing to frequent opening and closing of the movable and fixed contacts due to the overcurrent, the heat causes the meltable metal to melt so that the head portion of the adjusting screw is separated from the screw portion thereof. Accordingly, the spring member acts to push the disc-shaped bimetallic member so that the movable contacts are disengaged from the respective fixed contacts.

In order to achieve the second object, the above-described spring member is formed from a shape-memory alloy.

When the temperature of the meltable metal is raised high enough to melt with the movable contacts welded to the respective fixed contacts, the spring member formed from the shape-memory alloy is extended so as to take a previously memorized length, thereby pushing the disc-shaped bimetallic member and the head portion of the adjusting screw. Consequently, when the pushing force overcomes the welding force between the movable and fixed contacts, the movable contacts are disengaged from the respective fixed contacts.

While, it is considered that the spring force of the spring member is beforehand set so as to take a value large enough to overcome the welding force between the movable and fixed contacts to disengage the movable contacts from the respective fixed contacts. However, when the spring force of the spring member is beforehand set so as to take such a large value, an unnecessary force acts on the disc-shaped bimetallic member during its normal overcurrent protecting operation, which is affected by the force. However, the use of the spring member formed from the shape-memory alloy solves the above-described problem.

Other and further objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

A first embodiment of the present invention will now be described with reference to FIGS. 1 to 3 of the drawings.

Figure 1:
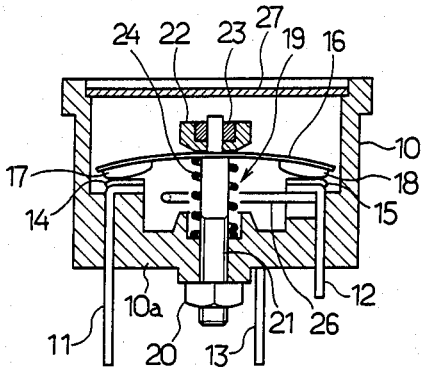
FIG. 1 is a longitudinal cross sectional view of the thermal relay of a first embodiment in accordance with the invention.
Figure 2:
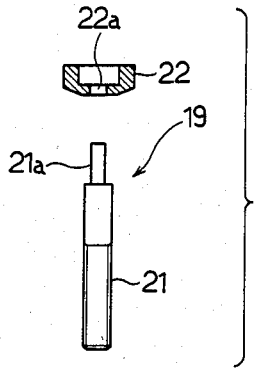
FIG. 2 is an exploded view of the adjusting screw employed in the thermal relay shown in FIG. 1.

Referring first to FIG. 1 illustrating the whole construction of the thermal relay, an electrically insulated housing 10 is formed into a cylindrical configuration with the upper end opened. Terminals 11 to 13 are extended through respective openings formed in the bottom wall 10*a* of the housing 10, to the interior of the housing 10 and secured in position. Two fixed contacts 14 and 15 are rigidly secured to the portions of the terminals 11 and 12 positioned in the housing 10, respectively. A disc-shaped bimetallic member 16 is provided within the housing 10. The disc-shaped bimetallic member 16 is formed so as to usually have an upwardly concave curvature, as seen in FIG. 1, which curvature will hereinafter be referred to as a first curvature. Two movable contacts 17 and 18 are rigidly secured to opposite ends of the disc-shaped bimetallic member 16 so as to correspond to the fixed contacts 14 and 15, respectively. An adjusting screw 19 is extended through a central opening formed in the bottom wall 10*a* of the housing 10 to the interior of the housing 10 and fixed in position with a nut 20. As shown in FIG. 2, the adjusting screw 19 comprises a screw portion 21 with which the nut 20 is threadably engaged and a head portion 22 having a small hole 22*a* which is engaged with the reduced diameter portion 21*a* of the screw portion 21. The screw portion 21 and the head portion 22 are coupled with each other with meltable metal 23 such as tin having a melting point of 232° C. A coil spring 24 serving as a spring member surrounds the screw portion 21 of the adjusting screw 19 between the disc-shaped bimetallic member 16 and the bottom wall 10*a* of the housing 10. The coil spring 24 acts to bias the disc-shaped bimetallic member 16 against the head portin 22 of the adjusting screw 19 to thereby support the bimetallic member 16 so that the movable contacts 17 and 18 are usually made into engagement with the fixed contacts 14 and 15, respectively, whereby a switching means 25 comprising these contacts is closed, the switching means 25 being illustrated in FIG. 3. A heater 26 is provided beneath the disc-shaped bimetallic member 16 in the housing 10. One end of the heater 26 is connected to the terminal 12 and the other end thereof is connected to the terminal 13. A cap 27 is provided for closing the upper open end of the housing 10.

Figure 3:
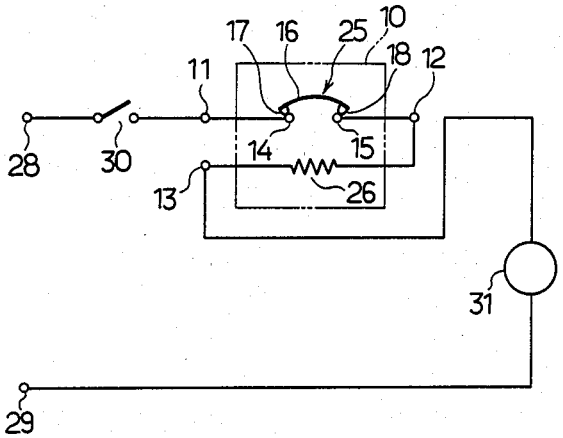
FIG. 3 is a circuit diagram showing an electrical arrangement in which the thermal relay in FIG. 1 is employed.

FIG. 3 illustrates an electrical circuit in which the above-described thermal relay is employed. An AC power supply terminal 28 is connected to the terminal 11 through a power switch 30. The terminal 13 is connected to an AC power supply terminal 29 through an electric motor 31 as the electrical equipment. More specifically, the power switch 30, switching means 25, heater 26, and motor 31 are connected between the AC power supply terminals 28 and 29 so as to form a series circuit.

Operation of the thermal relay will now be described. Upon closure of the power supply switch 30, an electrical current is drawn into the motor 31 through the power supply switch 30, switching means 25, and heater 26, thereby starting the motor 31. When an overcurrent due to overload or the like flows in the motor 31, the heater 26 generates heat as the overcurrent flows through the heater 26. When the temperature of the heater 26 reaches a predetermined value, the disc-shaped bimetallic member 16 reverses its curvature from the first curvature to the downwardly concave, second curvature so that the movable contacts 17 and 18 are rapidly made out of engagement with the fixed contacts 14 and 15, respectively, thereby opening the switching means 25. Consequently, the heater 26 and the motor winding circuit are interrupted, whereby the normal overcurrent protection operation is executed. Thereafter, when the disc-shaped bimetallic member 16 is cooled so as to reverse its curvature from the second to the first curvature, the movable contacts 17 and 18 are again made into engagement with the fixed contacts 14 and 15, respectively, whereby the switching means 25 is closed again and the current flows into the motor 31.

Where the cuase of the occurrence of overcurrent has not been eliminated, the switching means 25 alternately reiterates the closure and opening. At last, the movable contacts 17 and 18 are welded to the respective fixed contacts 14 and 15. Consequently, the overcurrent continually flows through the heater 26 and the ambient temperature is unusually increased. The unusually high ambient temperature causes the meltable metal 23 of the adjusting screw 19 to melt and accordingly, the head portion 22 is separated from the screw portion 21. Then, the coil spring 24 upwardly pushes the disc-shaped bimetallic member 16 and the head portion 22 integrally. The pushing force of the coil spring 24 overcomes the welding force between the movable and fixed contacts and the movable contacts 17 and 18 are disengaged from the fixed contacts 14 and 15, respectively, whereby the switching means 25 is forced to be opened to interrupt the heater 26 and the motor winding circuit. Even when the disc-shaped bimetallic member 16 is cooled thereafter and reverses its curvature from the second to the first curvature, the movable contacts 17 and 18 are prevented from being engaged with the respective fixed contacts 14 and 15 since the disc-shaped bimetallic member 16 is remained at the position to which the bimetallic member 16 is pushed by the coil spring 24, whereby the switching means 25 is kept opened. It should be noted that the coil spring 24 has a sufficient free length so that the movable contacts 17 and 18 are not brought into contact with the respective fixed contacts 14 and 15 in the above-described condition. Further, it should be noted that the free length of the coil spring 24 and the height of the reduced diameter portion 21*a* of the screw portion 21 or the space between the head portion 22 and the cap 27 are determined so that the head portion 22 is prevented from disengaging from the reduced diameter portion 21*a* when the disc-shaped bimetallic member 16 and the head portion 22 of the adjusting screw 19 are upwardly pushed by the coil spring 24.

Figure 4:
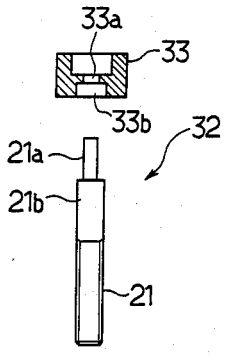
FIG. 4 is a view similar to FIG. 2 illustrating a second embodiment.

FIG. 4 illustrates a second embodiment of the invention. An adjusting screw 32 employed for the screw 19 comprises the screw portion 21 and a head portion 33 having a small hole 33*a* with which the reduced diameter portion 21*a* of the screw portion is fitted and a recessed portion 33*b* with which the increased diameter portion 21*b* of the screw portion 21 is fitted. The screw portion 21 and the head portion 33 are coupled with each other by the meltable metal.

The above-described construction of the thermal relay provides for the same effect as achieved in the first embodiment. Further, the stability of the head portion 33 may be increased.

Figure 5:
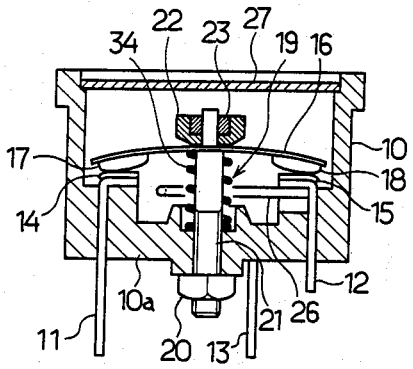
FIG. 5 is a view similar to FIG. 1 illustrating a third embodiment.
Figure 6:
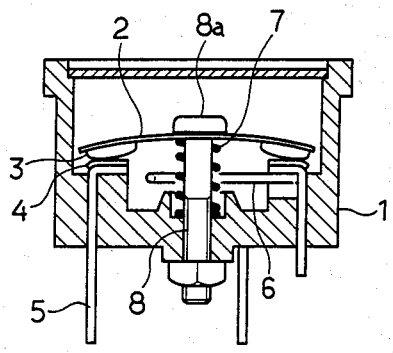
Fig. 6 (PRIOR ART)
FIG. 6 is a view similar to FIG. 1 illustrating the conventional thermal relay.

FIG. 5 illustrates a third embodiment. A coil spring 34 serving as the spring member is formed from a shape-memory alloy.

When the movable contacts 17 and 18 are made into engagement with the respective fixed contacts 14 and 15 and the ambient temperature is unusually increased so that the meltable metal 23 melts, the coil spring 34 formed from the shape-memory alloy is extended so as to take the previously memorized length, thereby upwardly pushing the disc-shaped bimetallic member 16 and the head portion 22 of the adjusting screw 19. The movable contacts 17 and 18 are then disengaged from the perspective fixed contacts 14 and 15 against the welding force.

Now, consider the case where the motor 31 shown in FIG. 3 is of the high power type and, for example, employed for driving a compressor of an air conditioner having the rated output power of 750W or more. Upon occurrence of the locked-rotor condition, the welding force between the movable contacts 17 and 18 and the respective fixed contacts 14 and 15 is increased since the locked-rotor current takes the value of 30 A or more. The coil spring 34 necessitates a spring force large enough to overcome the increased welding force. However, when the coil spring 34 is previously designed to have a large spring force, an extra force acts on the disc-shaped bimetallic member 16 in the case of the normal overcurrent protection operation, whereby the operation of the disc-shaped bimetallic member 16 is deleteriously influenced by the extra force.

According to the third embodiment of the invention, the coil spring 34 formed from the shape-memory alloy is extended so as to take the previously memorized length and imparts a large spring force for the first time when the ambient temperature is increased such that the meltable metal 23 melts. Accordingly, the disc-shaped bimetallic member 16 is not influenced by the large spring force in the case of its normal overcurrent protection operation.

Although the heater 26 is employed in each of the foregoing embodiments, the heater 26 may not be provided and instead, the disc-shaped bimetallic member 16 may be designed to reverse its curvature by way of self-heating.

Although, in each of the foregoing embodiments, the thermal relay of the invention is employed for protection of the electric motor against the overcurrent, the thermal relay of the invention may be employed for protection of the other electrical equipments against the overcurrent.

The foregoing disclosure and drawings are merely illustrative of the principles of the present invention and are not to be interpreted in a limiting sense. The only limitation is to be determined from the scope of the appended claims.

What I claim is:

1. A thermal relay comprising:

(a) a housing;

(b) two fixed contacts provided in the housing;

(c) a disc-shaped bimetallic member having two movable contacts and provided in the housing, the disc-shaped bimetallic member usually having a first curvature such that the movable contacts are made into engagement with the fixed contacts, respectively, the disc-shaped bimetallic member reversing its curvature so as to have a second curvature when heated to a predetermined value of its temperature, whereby the movable contacts are made out of engagement with the fixed contacts, respectively;

(d) an adjusting screw provided in the housing and comprising a screw portion and a head portion independent from the screw portion, the screw portion and head portion being coupled with each other by a meltable metal; and (e) a spring member biasing the disc-shaped bimetallic member to the head portion of the adjusting screw, thereby supporting the disc-shaped bimetallic member.

2. A thermal relay according to claim 1, wherein the spring member is formed from a shape-memory alloy.

* * * * *